United States Patent [19]

Daenen

[11] 4,262,683

[45] Apr. 21, 1981

[54] APPARATUS FOR PROCESSING STRIPS CUT FROM TOBACCO LEAVES

[75] Inventor: Bernardus Daenen, Uitgeest, Netherlands

[73] Assignee: Van der Molen Machinefabrick B.V., Zaandam, Netherlands

[21] Appl. No.: 74,521

[22] Filed: Sep. 11, 1979

[30] Foreign Application Priority Data

Sep. 21, 1978 [NL] Netherlands ..... 7809622

[51] Int. Cl.[3] ..... A24B 3/00

[52] U.S. Cl. ..... 131/327; 270/58

[58] Field of Search ..... 131/35, 33, 36, 105, 131/147 R, 149; 270/58; 271/302, 303, 279; 209/606, 643

[56] References Cited

U.S. PATENT DOCUMENTS

| | | | |
|---|---|---|---|
| 3,197,200 | 7/1965 | Byrt | 271/279 X |
| 3,542,038 | 11/1970 | Hooper et al. | 131/149 |
| 3,744,498 | 7/1973 | Imbert | 131/149 |
| 3,918,586 | 11/1975 | Tyler et al. | 209/643 X |
| 4,144,896 | 3/1979 | Daenen | 131/149 |

FOREIGN PATENT DOCUMENTS

| | | |
|---|---|---|
| 1179676 | 1/1970 | United Kingdom . |
| 1259564 | 1/1972 | United Kingdom . |
| 1302222 | 1/1973 | United Kingdom . |
| 1494067 | 12/1977 | United Kingdom . |
| 1532353 | 11/1978 | United Kingdom . |
| 1548301 | 7/1979 | United Kingdom . |

*Primary Examiner*—Stephen C. Pellegrino

*Attorney, Agent, or Firm*—Stevens, Davis, Miller & Mosher

[57] ABSTRACT

Apparatus for processing strips cut from tobacco leaves, comprising a first conveyor, an intermediate conveyor provided with means for detecting the strip length, a third conveyor on which a carrier of synthetic plastics material can be moved, means for the supply of glue and means periodically interrupting the supply of the plastics carrier. Above the first conveyor there are provided detection means, cutting means, and means for removing tobacco strips from the conveyor.

4 Claims, 1 Drawing Figure

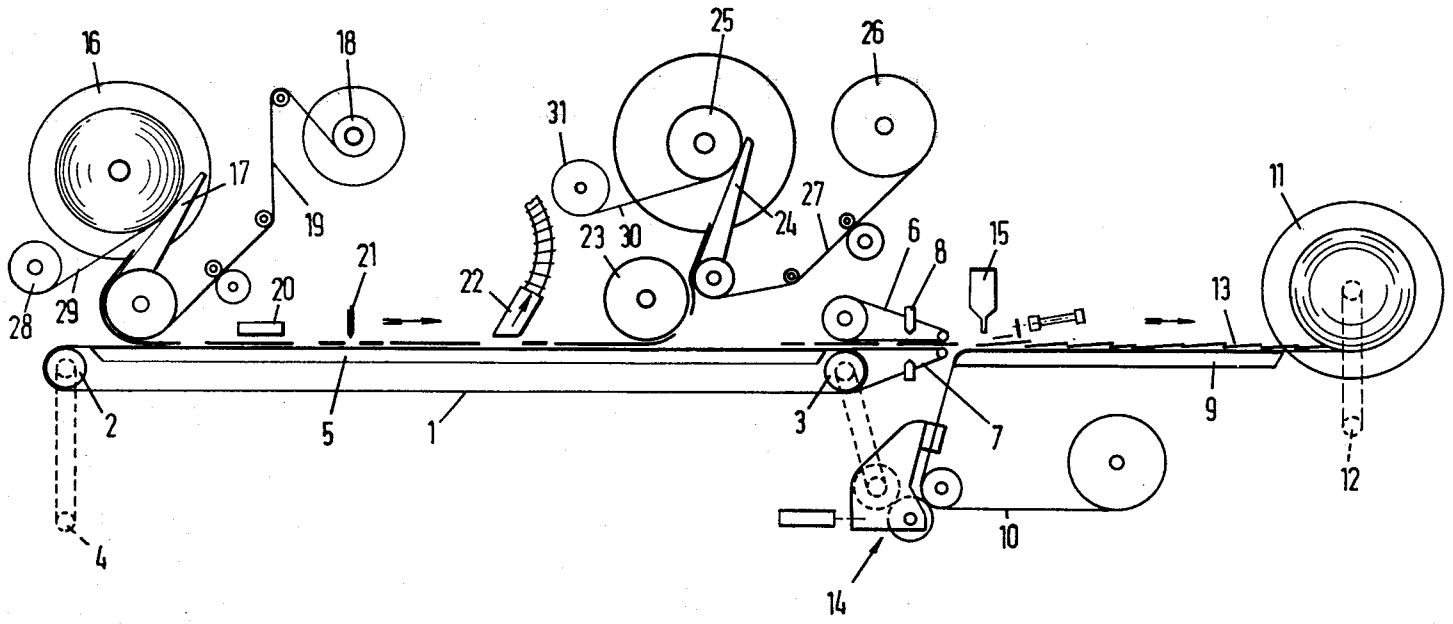
1
2
3
4
5
6
7
8
9
10
11
12
13
14
15
16
17
18
19
20
21
22
23
24
25
26
27
28
29
30
31

APPARATUS FOR PROCESSING STRIPS CUT FROM TOBACCO LEAVES

In the prior U.S. patent application Ser. No. 663,707, now U.S. Pat. No. 4,144,896, which is incorporated herein by reference, there is described an apparatus for processing strips cut from tobacco leaves, consisting essentially of a conveyor for said strips, an intermediate conveyor contiguous with said conveyor and including means for detecting the strip length, and a third conveyor contiguous to said intermediate conveyor, said third conveyor being formed by a support over which a plastics carrier, unwinding from a reel, can be moved, which carrier can again be wound on a roller or reel, there being provided at the beginning of the conveyor last-mentioned means for the supply of glue or a like adhesive, and there being further provided means for periodically interrupting a constant supply of the plastics carrier in accordance with the length of a tobacco strip being conveyed.

This apparatus serves for combining whole tobacco strips into a ribbon by lap-joining them together. When, in a later stage, a wrapper for a cigar is punched from the tobacco ribbon, this wrapper often has a number of joints. Furthermore, differences in colour may occur, because a wrapper may consist of strips cut from different tobacco leaves. For cigars on whose outward appearance not too high demands are made, this is less objectionable, and in cigars which are powdered, possible differences in colour or joints in the wrapper will generally be accepted.

More expensive cigars, which are practically always unpowdered are required to have a perfect wrapper, so that a ribbon made by the above method is less suitable for the cutting of wrappers for first-quality cigars from it.

It is an object of the present invention to supplement the above prior apparatus in such a manner that it offers the possibility of separating tobacco strips of a length at least equal to that of a complete wrapper for a cigar from a series of tobacco strips, and to wind it with a plastics carrier on a roller or reel, destined for cutting a wrapper for first-quality cigars from it. The shorter strips, i.e. short of the length required for a complete wrapper, are combined by being lap-joined together, to form a ribbon for the cutting of wrappers for cigars of a quality on which less high demands are made.

For this purpose, according to the invention, there are provided above the first conveyor detection means, cutting means, and means for removing from the conveyor strips of tobacco which satisfy a pre-determined length, which last-mentioned means is combined with winding means and means for supplying a plastics carrier.

One embodiment of the invention will be described, by way of example, with reference to the accompanying diagrammatic drawing.

The new apparatus is of the type as described in the above prior application, so that the corresponding parts described in it will not be discussed in detail herein.

The apparatus shown in the drawing comprises a conveyor 1 in the form of an endless belt passed over rollers 2 and 3. The belt is driven by means of a motor, as indicated at 4, via a rope, chain or like transmission. The upper run of the belt 1 travels over a guide 5, in which a partial vacuum can be generated. Contiguous with conveyor 1 is an intermediate conveyor consisting of narrow belts 6 and 7. Designated by 8 is a detection device, which checks the tobacco strips as to length. This arrangement is described in somewhat greater detail in the above prior patent application. Contiguous with intermediate conveyor 6, 7 is a third conveyor 9, which is of such construction that a partial vacuum can be generated therein. Over this conveyor 9, a carrier 10 of synthetic plastics material can be moved, which together with tobacco strips 13, united into a ribbon, can be wound on a roller or reel 11, which roller can be driven by a motor 12 or otherwise.

By 14 is indicated a device which causes carrier 10 to be intermittently moved, depending on the strip length of the tobacco as perceived by device 8.

Under certain conditions, the gum content of the tobacco to be processed is so high that the strips adhere together by nature. If this is the case to a lesser extent, however, a minor quantity of glue is needed. For this purpose a glue applicator 15 is provided above conveyor 9, which applicator can be commanded intermittently in the same way as carrier 10.

By 16 is designated a roller or reel on which tobacco strips are wound together with a carrier of synthetic plastics material. Cooperating with roller or reel 16 is a guide member 17, in which a partial vacuum can be generated. By 18 is designated a roller or reel on which a carrier 19 of synthetic plastics material can be wound.

Spaced some distance above conveyor 1 is a detector 20, followed by a cutter 21. Provided downstream of the cutter is an exhauster 22 or the like, with which damaged or undersized tobacco strips can be removed. One of the particular aspects of the new apparatus is the presence of a device 23, which is spaced some distance from the conveyor. This device 23 is combined with a guide member 24 and a winding drum or reel 25. Reference numeral 26 designates a supply roller for a carrier 27 of synthetic plastics material. Guide member 24 is arranged so that a partial vacuum can be generated therein.

The operation of the apparatus according to the invention is as follows.

Tobacco strips previously cut to width and wound together with a plastics carrier onto drum 16 are wound off that drum to land onto conveyor 1. Carrier 19 is provided with perforations so that during transport over guide member 17 the strips of tobacco are drawn against the carrier. Carrier 19 is re-wound on drum or reel 18 for later re-use.

During their transport, the tobacco strips pass under detector 20. These strips remain flat on conveyor 1 as a result of a partial vacuum prevailing in guide 5. Detector 20 determines the length of a tobacco strip being moved under it. If this length corresponds to at least one full wrapper for a cigar, a command for device 23 is stored. As soon as the detected tobacco strip passes that device, then as a consequence of a partial vacuum generated therein, the strip is removed from the conveyor and deflected into the direction of roller 25.

Roller 26 supplies, naturally in an intermittent manner, a piece of plastics carrier 27 corresponding to the length of the detected strip, which strip is wound on roller or reel 25 together with the carrier. Here again, the strip of tobacco is kept in contact with carrier 27 by a partial vacuum in guide member 24. The new apparatus is accordingly capable of separating from a series of strips of tobacco strips having a length not less than a pre-determined minimum size. The detector also scans the tobacco strips for tears and holes, whose presence triggers a command being given to exhaust 22. This waste is then removed from the series of tobacco strips.

Whole tobacco strips which do not satisfy the above minimum size pass by device 23 and are combined into a ribbon as described in detail in the prior patent application referred to. The strips 13 are interconnected in overlapping relationship and wound on a drum, roller or reel together with plastics carrier 10. The ribbon thus formed is used for wrapping cigars on whose outward appearance less high demands are made.

As appears from the above and from the accompanying drawing, loose tobacco strips are removed from roller 16. As a consequence of the adhesion of the tobacco, it might be possible for a tobacco strip, in spite of the suction effect of device 17, to fail to be released by the carrier. To prevent this, a narrow plastic tape has been wound along with the tobacco strips zig-zag wise in making the roll. This tape should again be removed from the tobacco strips before they reach conveyor 5. For this purpose a driven roller 28 is provided, on which the tape, designated by 29, is wound.

In making the roll on roller 25, a tape 30 is wound along off a roller 31 for the same reason.

What I claim:

1. Apparatus for processing strips cut from tobacco leaves, consisting essentially of a first conveyor for said strips, an intermediate conveyor contiguous with said first conveyor, and provided with means for detecting the strip length, and a third conveyor contiguous with said intermediate conveyor and formed by a support on which a first carrier of synthetic plastics material, being wound off a reel, can be moved, which first carrier can again be wound on a roller or reel, there being provided at the beginning of the third conveyor means for the supply of glue or a like adhesive for gluing strips together into a ribbon and there being further provided means periodically interrupting a constant supply of the plastics carrier in accordance with the length of a tobacco strip being transported, characterized in that there are provided above the first conveyor detection means, followed by cutting means for the tobacco strips, and means for removing from the conveyor tobacco strips satisfying a pre-determined length, winding means combined with the tobacco strip removing means and means for the supply of a second carrier of synthetic plastic material.

2. Apparatus as claimed in claim 1, wherein the means for removing from the conveyor tobacco strips having a predetermined length consist of a vacuum drum connected to a guide member in which a vacuum can be generated.

3. Apparatus as claimed in claim 1 or 2, wherein a driven roller is provided between a supply roll of tobacco strips and the first conveyor, on which driven roller a separating tape, applied zig-zag wise to the supply roll, can be wound.

4. Apparatus as claimed in claim 1 or claim 2, wherein the winding means include a roller for making a roll of the tobacco strips of length at least equal to a wrapper, and including a roller with a separation tape, which is wound together with the tobacco strips and second carrier.

* * * * *

UNITED STATES PATENT AND TRADEMARK OFFICE

CERTIFICATE OF CORRECTION

PATENT NO. : 4,262,683

DATED : April 21, 1981

INVENTOR(S) : Bernardus DAENEN

It is certified that error appears in the above-identified patent and that said Letters Patent are hereby corrected as shown below:

On the cover page, the name of the Assignee should appear as follows:

Van der Molen Machinefabriek B.V., Zaandam, Netherlands

Signed and Sealed this

*Third* Day of *November 1981*

[SEAL]

*Attest:*

GERALD J. MOSSINGHOFF

*Attesting Officer*

*Commissioner of Patents and Trademarks*